US008640686B2

(12) United States Patent
Pugh et al.

(10) Patent No.: US 8,640,686 B2
(45) Date of Patent: Feb. 4, 2014

(54) TILE REBATE CUTTING APPARATUS

(76) Inventors: Daniel Pugh, Romford (GB); Darren Pugh, Romford (GB)

( * ) Notice: Subject to any disclaimer, the term of this patent is extended or adjusted under 35 U.S.C. 154(b) by 666 days.

(21) Appl. No.: 12/738,444

(22) PCT Filed: Oct. 14, 2008

(86) PCT No.: PCT/GB2008/003491

§ 371 (c)(1),
(2), (4) Date: Nov. 3, 2010

(87) PCT Pub. No.: WO2009/050452

PCT Pub. Date: Apr. 23, 2009

(65) Prior Publication Data

US 2010/0242290 A1 Sep. 30, 2010

(30) Foreign Application Priority Data

Oct. 18, 2007 (GB) ..... 0720419.1

(51) Int. Cl.
*B28D 1/04* (2006.01)

(52) U.S. Cl.
USPC ..... 125/14; 30/287; 30/292; 30/293; 30/294; 125/13.01; 125/38

(58) Field of Classification Search
USPC ..... 30/277.4, 320, 347, 292, 293, 294, 289, 30/287, 299; 83/869; 125/12, 13.01, 14, 125/38; 451/65, 69
See application file for complete search history.

(56) References Cited

U.S. PATENT DOCUMENTS

| | | | | |
|---|---|---|---|---|
| 3,242,780 | A | 3/1966 | Ried et al. | |
| 4,589,207 | A | 5/1986 | Loth et al. | |
| 4,735,531 | A * | 4/1988 | Boerckel et al. | 409/182 |
| 4,777,724 | A | 10/1988 | Sirchia | |
| 4,983,081 | A | 1/1991 | Cunningham, Jr. | |
| 5,040,297 | A | 8/1991 | Scheinost | |
| 5,996,237 | A * | 12/1999 | Sanders | 33/42 |
| 8,141,256 | B1 * | 3/2012 | Siblik | 30/287 |
| 2003/0097758 | A1 | 5/2003 | Frazier | |
| 2003/0182807 | A1 | 10/2003 | Lin et al. | |
| 2003/0200663 | A1 | 10/2003 | Clanton | |
| 2012/0090264 | A1 * | 4/2012 | Goss | 52/741.4 |

FOREIGN PATENT DOCUMENTS

| | | | |
|---|---|---|---|
| DE | 19950431 | A1 | 4/2001 |
| DE | 20309886 | U | 10/2003 |
| EP | 0826466 | A | 3/1998 |
| EP | 1839789 | A | 10/2007 |
| GB | 814840 | A | 9/2008 |

OTHER PUBLICATIONS

Prior, Michael, United Kingdom Intellectual Property Office, Combined Search and Examination Report under Section 17 &18(3), 4 pages, (Apr. 20, 2009).

Demeester, Jan, European Patent Office International Searching Authority, Patent Cooperation Treaty International Search Report for PCT/GB2008/003491.

* cited by examiner

*Primary Examiner* — Timothy V Eley
(74) *Attorney, Agent, or Firm* — Rita C. Chipperson; Chipperson Law Group, P.C.

(57) ABSTRACT

A tile rebate cutting apparatus has a guide member, which may be formed by a spirit level, forming a linear guide for a rebate cutting tool, the rebate cutting tool incorporating at least one cutting device, the rebate cutting tool being adapted to engage with said guide member to move along a predetermined line determined by the position of the guide member to enable a cut for a rebate to be made in a ceiling tile.

21 Claims, 7 Drawing Sheets

TILE REBATE CUTTING APPARATUS

CROSS-REFERENCE TO RELATED APPLICATIONS

This application claims the benefit of and is a national phase filing of the PCT patent application entitled "Tile Rebate Cutting Apparatus" having International Application No. PCT/GB2008/003491, filed Oct. 14, 2008, which claims the benefit of the Great Britain patent application having application no. 0720419.1, filed Oct. 18, 2007, both of which are hereby incorporated by reference in their entirety as if fully set forth herein.

BACKGROUND OF THE INVENTION

The present invention relates to tile rebate cutting apparatus, and particularly but not exclusively relates to an apparatus for cutting rebates on the periphery of ceiling tiles intended for use with suspended ceilings in offices and the like.

In such suspended ceilings, a framework formed of aluminum strips, arranged in a regular pattern to define squares each adapted to receive a tile or panel, is first secured in the desired position, and the ceiling tiles are then placed in the framework to provide a smooth ceiling in which recessed lights may also be incorporated. Typically, the tiles just rest on the framework and in many installations the framework projects below the general plane of the tiles. This is visually unattractive and the preferred option is to provide the tiles with a peripheral rebate which rests on the framework so that the face surface of the tile lies flush with the framework. The ceiling is thus given a visually smooth and attractive appearance.

However, rooms into which a suspended ceiling is fitted are extremely rarely the right size for the ceiling to need only square tiles of the fixed size. As a result, it is invariably necessary to cut the tiles down to fit the final space adjacent all four walls. As a result, the side of the tile which is being cut to reduce its size does not have a rebate and it is therefore necessary for the installer to cut such a rebate. Typically, with modern plastic ceiling tiles which are formed of an expanded or foamed plastic material, this is carried out by the operator using a sharp knife and straight edge to cut partially through the tile from its face to the depth of the rebate and then from the side edge to make another cut at right angles to the first to thereby cutaway the material to form the necessary rebate. This method has the disadvantage that it is extremely slow and time consuming to make the necessary cuts and it is also difficult to ensure that the cuts are accurately positioned, with the result that the tiles can be spoiled causing unnecessary wastage, whilst the resulting appearance of the ceiling can be compromised. The use of a sharp knife such as a utility knife is potentially hazardous and is responsible for many accidents.

The present invention seeks to overcome or minimize these problems.

BRIEF SUMMARY OF THE INVENTION

According to one aspect of the present invention, there is provided a tile rebate cutting apparatus having a guide member forming a linear guide for a cutting tool, and a rebate cutting tool incorporating at least two cutting devices, the rebate cutting tool being adapted to engage with said guide means to move along a predetermined line determined by the position of the guide means to enable a cut forming a rebate to be made in the edge of the tile, one cutting device being arranged to make first rebate cut in the surface of a tile and the other cutting device being arranged to complete the rebate by making a cut in the edge of the tile at right angles to the first rebate cut which meets with the first rebate cut thereby to sever a piece of material from the tile to form the rebate.

Preferably, a further cutting tool is provided which is adapted to engage with the guide member and incorporates a cutting device positioned relative to the guide member so as to cut the tile to size, prior to the rebate being cut by the rebate cutting tool.

Preferably, the guide means comprises an elongate member having at least one raised guide rail extending along its length. Preferably, two such raised guide rails are provided arranged in spaced parallel relationship.

Preferably, one or more of the cutting tools has an elongate groove or recess adapted to engage with the rail or rails on the guide means.

In a preferred embodiment, the guide means is formed of an aluminum extrusion and one or more of the cutting tools has a main body formed of an aluminum extrusion.

The cutting device may comprise a fixed blade the cutting depth of which may be adjustable but, preferably, the cutting device or devices comprise rotatable cutting wheels which may be diamond tipped.

According to a second aspect of the invention, there is provided a rebate cutting tool incorporating at least one cutting device, the rebate cutting tool been adapted to engage with a spirit level to move along a predetermined line determined by the position of the spirit level to enable a cut forming a rebate to be made in the tile.

In a preferred embodiment of the invention, the tool has a chassis engageable with the guide means so as to be slidable therealong, the chassis carrying a cutting tool carrier having a body pivotally mounted on the chassis so as to be pivotal between a tile cutting position and a rebate cutting position.

Preferably, the carrier has a first tile cutting part and a second rebate cutting part angularly positioned with respect to the first part, the arrangement being such that when one of the parts is in its cutting position, the other part is pivoted to a position in which its cutting devices are clear of a tile being cut.

The relative positions of the cutting devices on the carrier may be adjustable.

The apparatus may have a drive motor for driving the cutting devices, which may be a battery powered electrical motor.

Preferably, the guide means comprises an extrusion of constant cross section, and the chassis has a mating cross section engageable therewith, the cross sections being such as to enable the chassis to slide along the guide means but to be constrained against movement in the lateral planes.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. Preferred embodiments of the present invention will now be described by way of example with reference to the accompanying drawings in which.

DETAILED DESCRIPTION OF THE INVENTION

Figure 1:
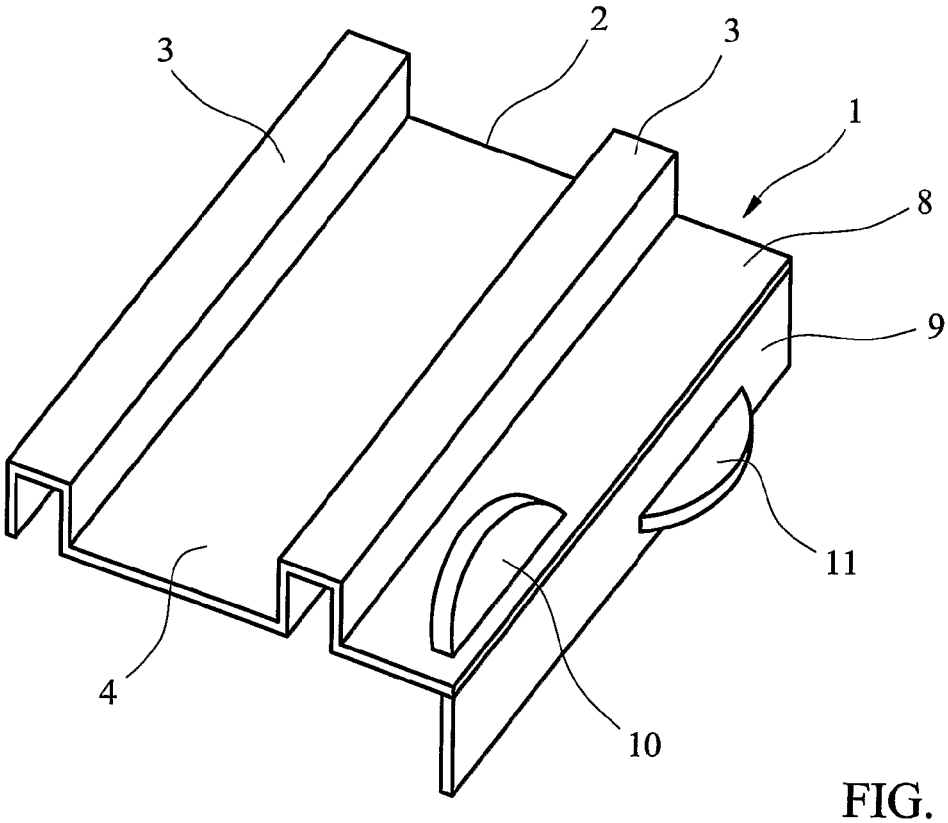
FIG. 1 shows a schematic perspective view of a rebate cutting tool in accordance with the present invention.

Referring now to FIGS. 1-4 of the drawings, there is shown in FIG. 1 a rebate cutting tool 1 for cutting a rebate along one edge of a ceiling tile of the type which is typically formed of a foamed or expanded plastic material. The cutting tool 1 consists of a main body 2 typically formed of extruded aluminum, which has two downwardly open channels 3 arranged in spaced parallel relationship separated by a base element 4 of the main body. The two channels 3 are adapted to engage with two guide rails 5 located in spaced parallel relationship on a guide member 6 (see FIG. 3), which again may be formed from an aluminum extrusion. On its underside, the guide member 6 has strips of a material 7 such as rubber bonded to or inset in the guide member to provide the guide member 6 with a nonslip underside. Many other forms of non-slip surface may be provided.

As shown particularly in FIG. 1, the rebate cutting tool 1 has a further base element 8 aligned with the base element 4 located on one side of one of the channels 3. At its free end, the further base element 8 has a downwardly depending web 9 which serves as an abutment arranged to butt up against the side edge of a ceiling tile to position the cutting tool 1.

The tool 1 includes a first cutting device 10 in the further base element 8 which is adapted to form a cut along a line in the surface of the tile which is a predetermined distance required by a rebate from the edge of the tile. A further cutting device 11 is located in the downwardly depending web 9 which is adapted to form a cut along a line in the edge surface of the tile to meet up with the cut formed in the surface of the tile to enable a portion of material to be removed to thereby form a rebate along the edge of the tile which is such as to enable the tile to fit into a framework of a suspended ceiling so that the tile lies flush with the surface of the ceiling framework.

The cutting devices 10, 11 in the embodiment shown comprise rotatable wheels, which may be diamond tipped. It is also possible in an alternative form for the cutting devices to comprise cutting blades which may be of the replaceable type as used in a Stanley® knife. The cutting depth of the blades. or of the wheels, may be adjustable by means not shown to suit different thicknesses of tile or size of rebate required.

Figure 2:
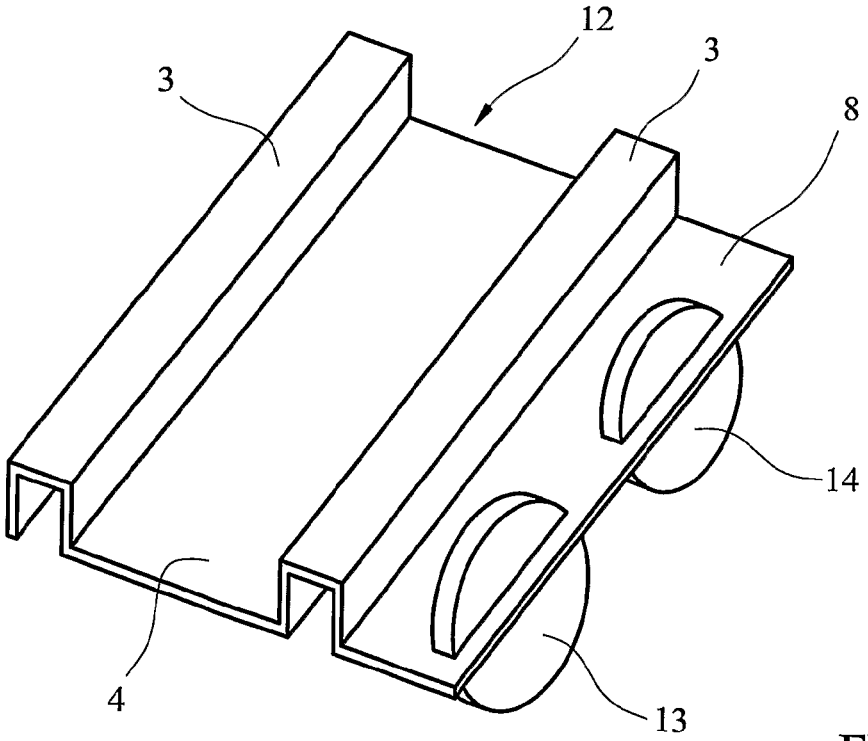
FIG. 2 shows a further cutting tool for cutting a tile to size.
Figure 3:
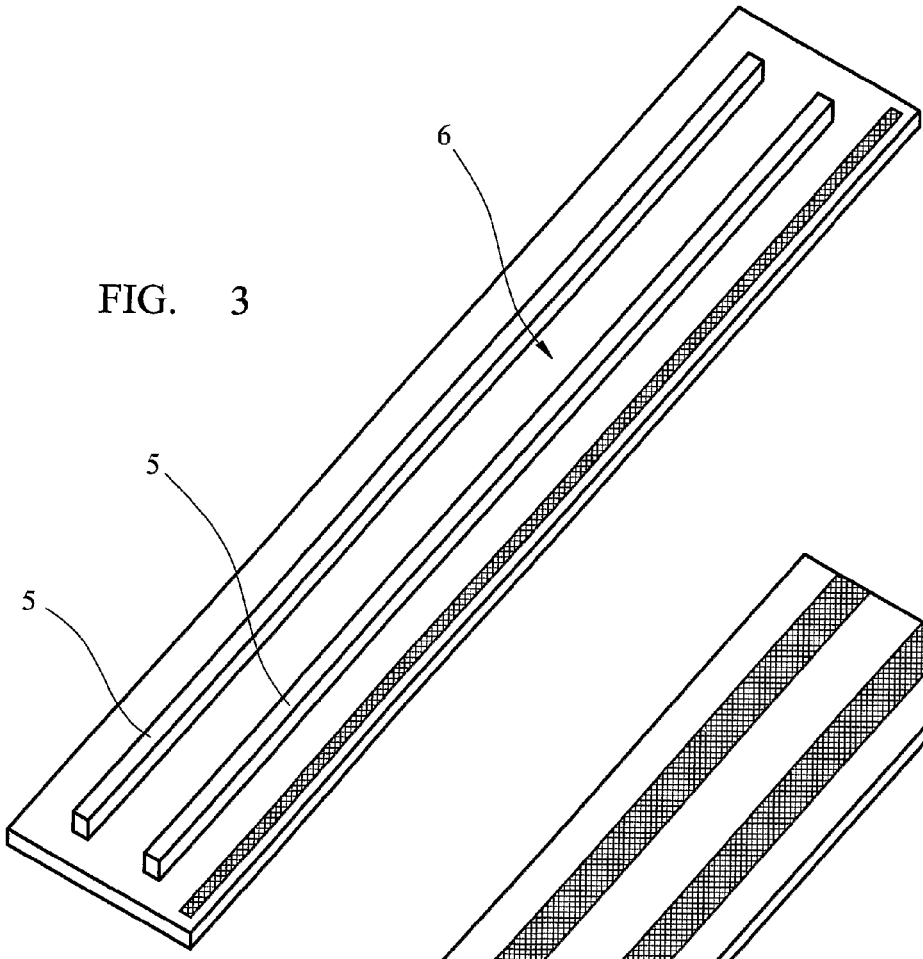
FIG. 3 shows a guide member for the cutting tools.
Figure 4:
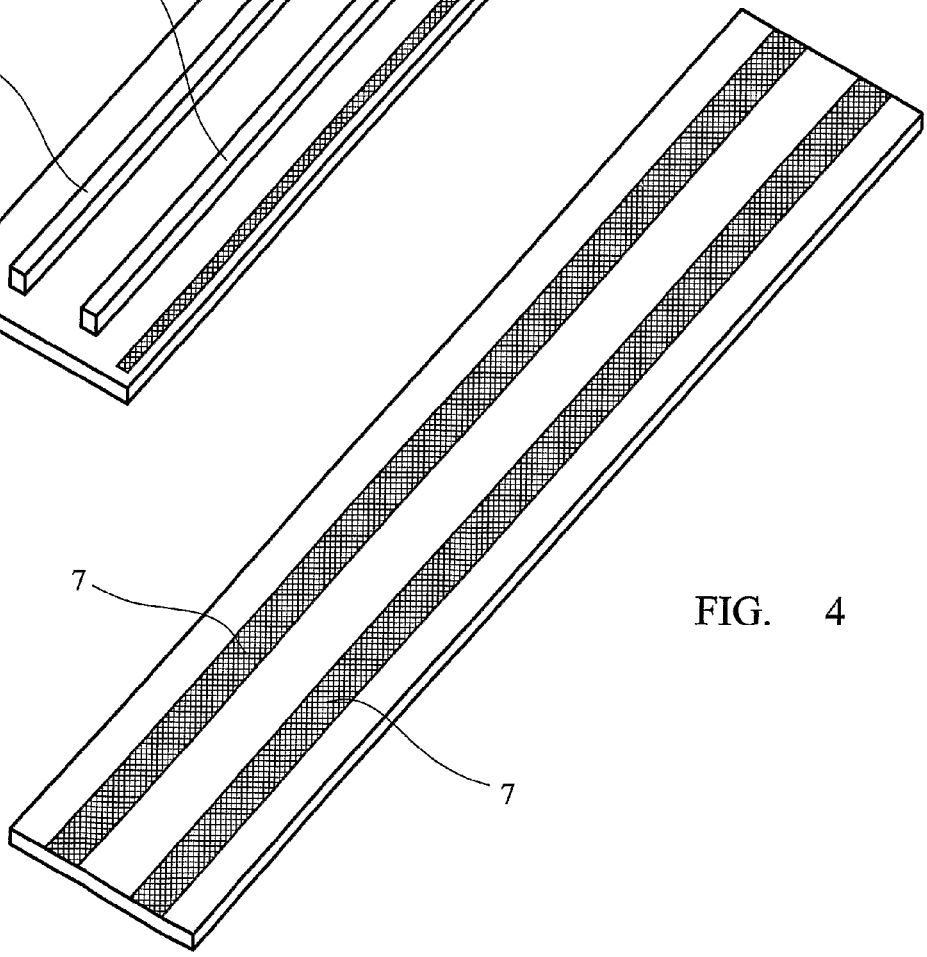
FIG. 4 shows the underside of the guide member.

FIG. 2 shows a similar cutting tool in which like parts bear like references. This cutting tool 12 comprises a parting off tool which is designed to cut a ceiling tile to size. It has two downwardly open channels 3, similar to the rebate cutting tool 1, and in the further base element 8 has at least one, and preferably two, as shown, parting off wheels, reference 13 and 14.

In operation, the guide member 6 is secured to a ceiling tile by a clamp or even by manual pressure, and the tile is cut to size by means of the parting off tool 12. Then, without having to reposition the guide member 6, the rebate forming tool is used to cut a rebate in the new edge of the tile. Again, although rotatable cutting wheels are illustrated, the tool may have a fixed blade as described above with reference to the rebate cutting tool. The depth of cut may be adjustable to suit different thicknesses of ceiling tile.

Figure 5:
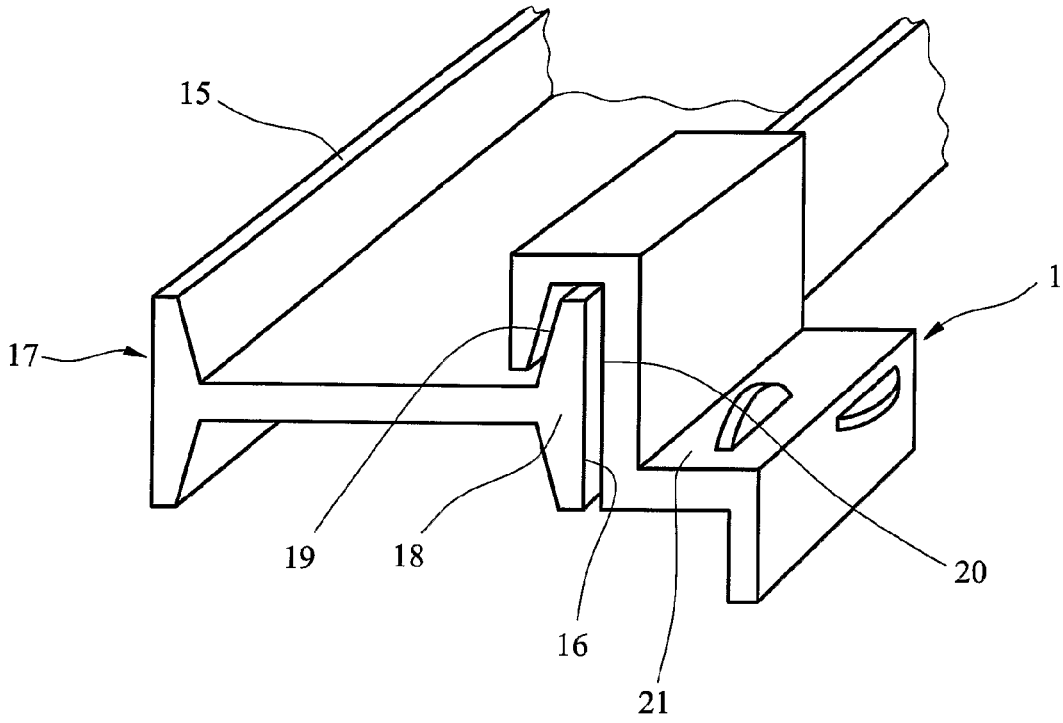
FIG. 5 shows an alternative embodiment of the invention.

Referring now to FIG. 5, there is shown an alternative embodiment of the invention in which the rebate cutting tool 1 is adapted to engage a guide member formed by a spirit level 15. The spirit level 15 is of the type formed of an I-section aluminum extrusion and has two opposite machined faces 16 and 17.

In this embodiment, the rebate cutting tool 1 has a downwardly open groove or channel 19 which is adapted to engage over one crosspiece 18 of the I-section, as shown. The tool has a planar face 20 adapted to abut the machined face 16 of the spirit level and dimensioned so that when the tool is placed with its channel engaged over the edge of the spirit level as shown, a base element 21 of the tool rests on the surface of the tile to be cut. Thus, by moving the tool 1 along the spirit level 15, a rebate can be cut as described before. Similarly, a corresponding parting off cutting tool may be provided.

In an alternative embodiment (not illustrated), the cutting tool has a large downwardly open channel with two inwardly opposing flat faces which are adapted to engage over the machined faces of the spirit level. In yet another embodiment, the spirit level is designed to be used in the upright position with one machined face resting on the surface of a tile with the cutting tool being adapted to rest on the upper machined face and to engage the sides of the machined face.

Figure 6:
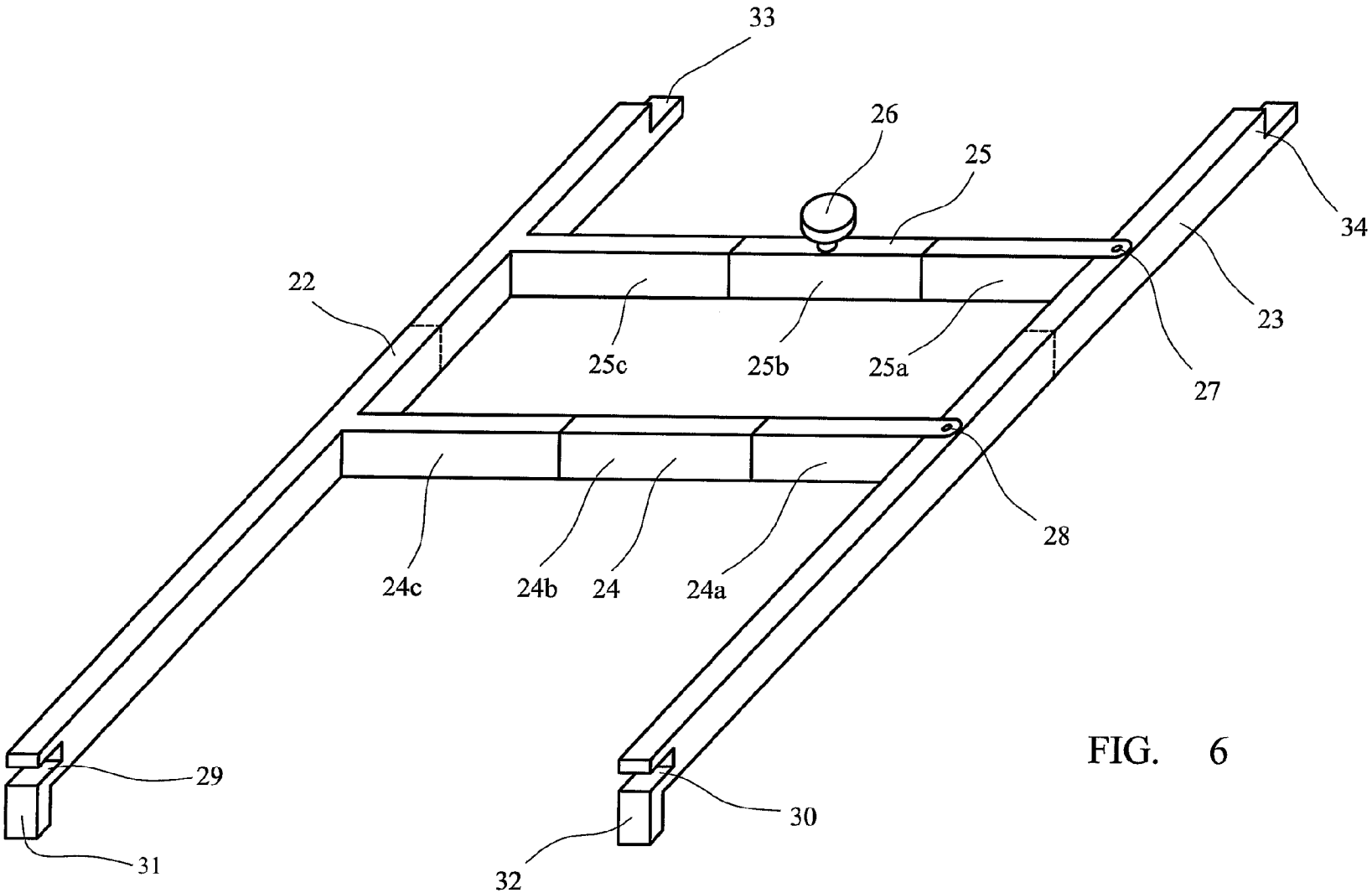
FIG. 6 shows a tool for determining the cutting line for a rebate.

Referring now to FIG. 6, there is shown a tool for determining the precise position for cutting the line in dependence upon the size of the opening in the ceiling track which must be filled by a tile. The tool consists of two elongate side members 22 and 23, which are joined by two transverse members 24 and 25, which are telescopic to enable the spacing between the two side members to be varied. As shown, the transverse members have three telescopic sections, 24*a*, 24*b*, 24*c* and 25*a* 25*b* and 25*c*. A manually operable clamp 26 is shown for clamping the telescopic member 25 in a desired position and a similar knob is preferably provided for the transverse member 24. The two telescopic sections 25*a* and 24*a* pivotally connect to the side member 23 via pin joints 27 and 28 to enable the side member 23 to be displaced relative to the side member 22.

At the lower end, as shown in the drawing, recesses 29 and 30 are formed in the end face of each of the side members which recess is adapted to slide onto the track of the suspended ceiling. At the end of the side members, there are depending abutments 31 and 32, respectively. At the other end of the side members 22 and 23, rebates 33 and 34 are formed.

In operation, it is often necessary to cut a tile to size to fit into a non regular space between the main track framework of the suspended ceiling and the wall of the room. With this tool of the present invention, the recesses 29 and 30 are first inserted onto the track section extending away from the wall and the side member 22 is pushed up against the track section spaced from the wall. The rebates 33 and 34 are located at the other end of the side members about the edge of the opposing track section extending away from the wall. The side member 23 is then manually pushed up against the track section secured to the wall. If the wall is at an angle, the side member 23 pivots about the pin joints 27 and 28 to lie at an angle to the side member 22. The manually operable clamping screws 26 are then tightened on the two transverse members 24 and 25. In this way, the precise line along which the tile must be cut and the rebate formed is determined. The tool is then removed from the track and placed on the tile with the abutments 31 and 32 abutting the edge of tile. The tile can then be cut accurately to size and the rebate formed.

Figure 7:
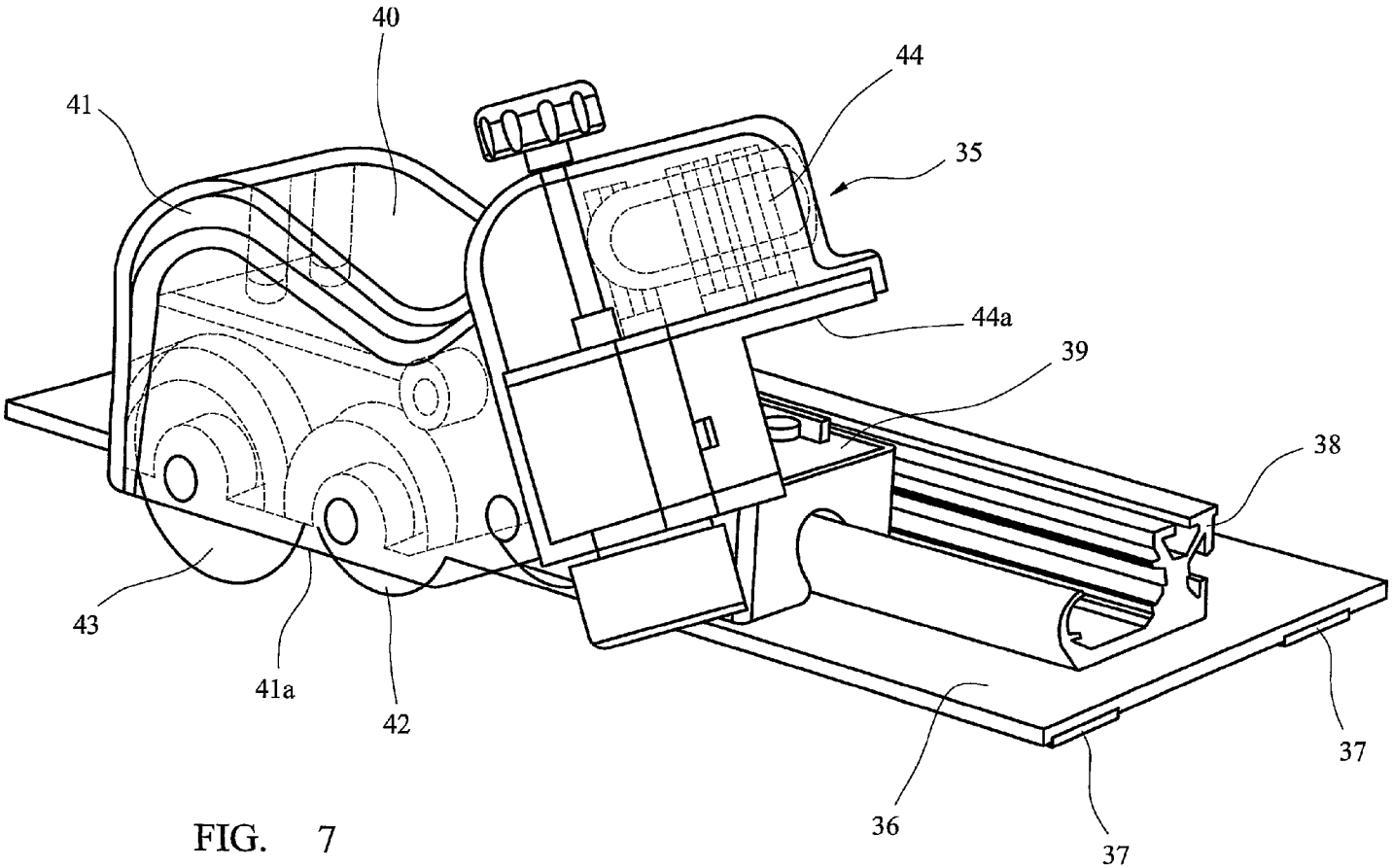
FIG. 7 shows a perspective view of a further embodiment.

Turning now to FIG. 7, there is shown a cutting tool 35 in which the operations of cutting a tile to size and cutting a rebate are combined into one tool. The apparatus is provided with a base board 36 carrying on its underside friction pads 37 which serve to hold the base member on a tile without slipping. The base board 36 carries an elongate guide member 38 formed of an aluminum extrusion, although it could be formed of a plastic material. The cutting tool 35 has a chassis 39 which is adapted to engage and slide along the guide member 38. The cross-sectional profile of the guide member 38 is engaged by a mating cross-sectional recess in the chassis 39 so that the chassis 39 is slidable along the member 38 but is constrained against any lateral movement in either plane.

Figure 8:
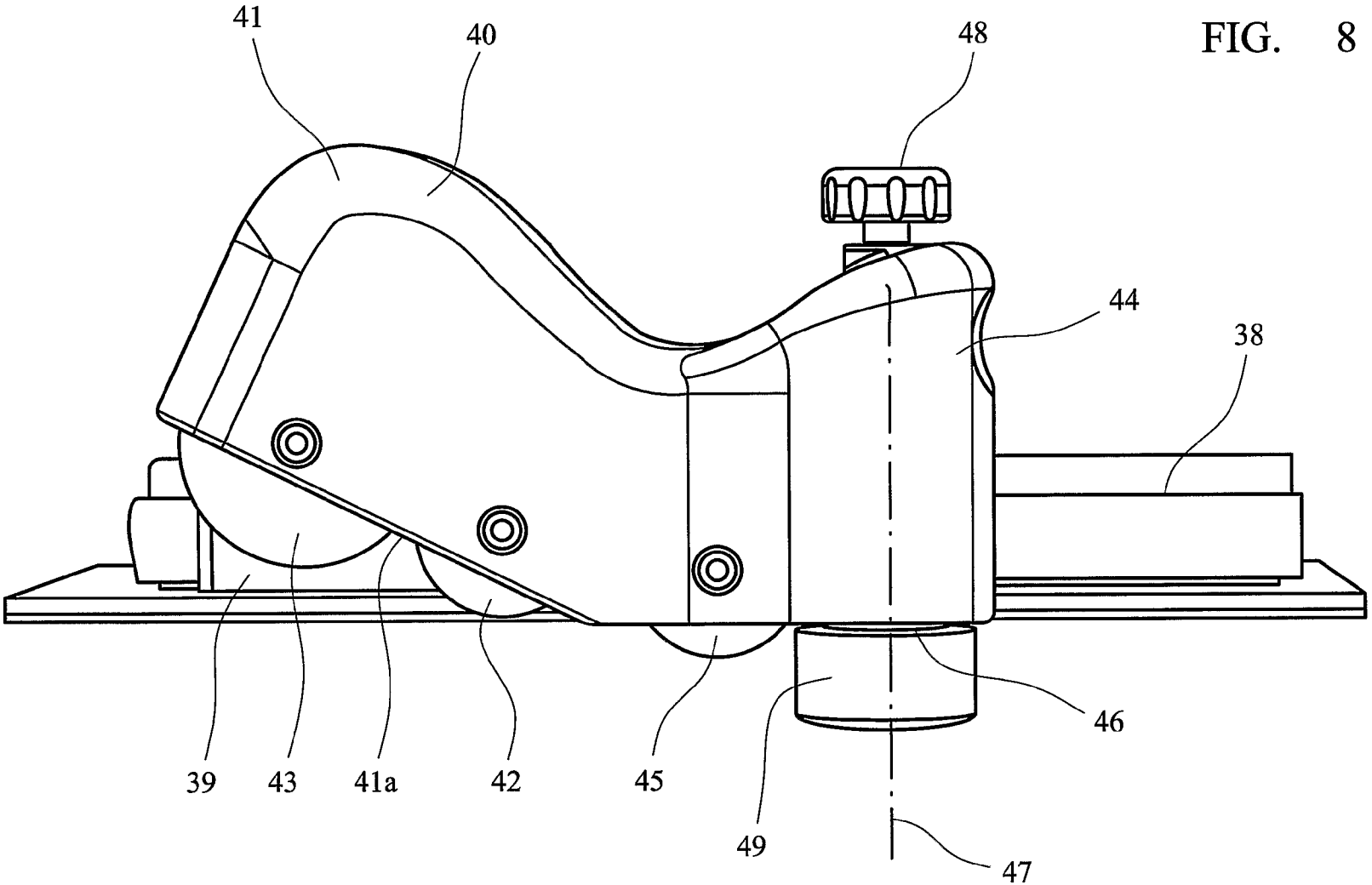
FIG. 8 shows a side view of the embodiment depicted in FIG. 7.

The chassis 39 carries a body comprising a cutting tool carrier 40 which is pivotally mounted on the chassis 39 so as to pivot between a tile cutting position shown in FIG. 7 for cutting a tile to size and a rebate cutting position as shown in FIG. 8. In the position shown in FIG. 7, the carrier has a rear, tile cutting part 41 having a lower planar face 41*a* which rests on the chassis 39 so as to be essentially in a horizontal position relative to the plane of the base board 36. This cutting part 41 of the cutting tool carries two rotatable cutting wheels 42 and 43, which are rotatable about axes parallel to the plane of the base board 36 to thereby be enabled to cut a tile to size about a plane normal to the plane of the tile. The depth of cut of the first wheel 42 is less than that of the second wheel 43, the wheel 42 being of smaller diameter which thus serves as a pilot cutter to cut part way through a tile so that the larger cutting wheel 43 will then complete the cut through the tile. In this embodiment, the axes of the two cutting wheels 42 and 43 are fixed relative to the face 41*a* and hence the face of a tile but it is possible in other embodiments that the axes of rotation of these two cutting members relative to the base board are adjustable to accommodate tiles of different thicknesses.

Still referring to FIG. 7, the carrier 40 has a forward, rebate cutting part 44 having a lower planar face 44*a* inclined upwardly at an angle relative to the face 41*a*. As depicted in FIGS. 7 and 8, the carrier part 44 has a rebate cutting wheel 45 with an axis parallel to, but spaced from, the axis of rotation of the cutting wheels 42 and 43, and projects from the lower face of the carrier to the extent required to cut the depth of a rebate. The cutting line of the wheel 45 is set back from the cutting line of the wheels 42 and 43 to provide the correct inset for the rebate without having to re-position the tool. Although shown as a fixed axis, it is possible in certain embodiments that the position of this axis is adjustable relative to the base board 36 to thus provide different depths of rebate cut. The position of the wheel 45 along the axis may also be adjustable to alter the size of the rebate. The carrier part 44 also carries a lateral rebate cutter cutting wheel 46, which is rotatable about an axis 47 normal to the plane of the base board 36 to make a rebate cut in the side edge of a tile. The carrier part 44 carries an adjusting device 48 to adjust the position of the cutter 46 relative to the base board 36 to enable the position of the rebate cut in the side of a tile to be adjusted in dependence upon the thickness of the tile and the size of rebate required. The horizontal cutter wheel 46 is enclosed by a cover 49 apart from its cutting section. When the carrier 40 is tipped forwardly about its pivot axis, the face 44*a* abuts the upper horizontal face of the chassis 39. In this position, the cutting wheels 45 and 46 are in a position to cut a rebate and the wheels 42 and 43 are lifted clear of the tile being cut, as shown in FIG. 8.

In operation, to cut a tile to size, the base board 36 is placed on the tile at the desired location, the cutting tool 35 is positioned on the rear edge of the base board 36 and the chassis 39 engages with the guide member 38. The operator places the base board 36 on the desired position on a tile and then manually presses down on the rear part 40 of the cutting tool and pushes it along the guide member to thereby sever the tile. The operator then pivots the cutting tool to the rebate cutting position shown in FIG. 8 and draws the tool back across the tile which enables the two cutting wheels 45 and 46 to form the rebate.

In this embodiment, the cutting wheels are freely rotatable, but it is envisaged that in a further embodiment, the wheels are rotatably driven by an electric motor connected to the cutting wheels through a gear train or a toothed belt. It is envisaged that the drive to each section 41 and 44 may be disconnected when the part 41 or 44, as the case may be, is not in the cutting position. The electric motor is preferably powered by a rechargeable battery. This embodiment is particularly useful for cutting heavy duty tiles, particularly those formed of heavier, denser materials such as plasterboard or similar gypsum-based materials.

Figure 9:
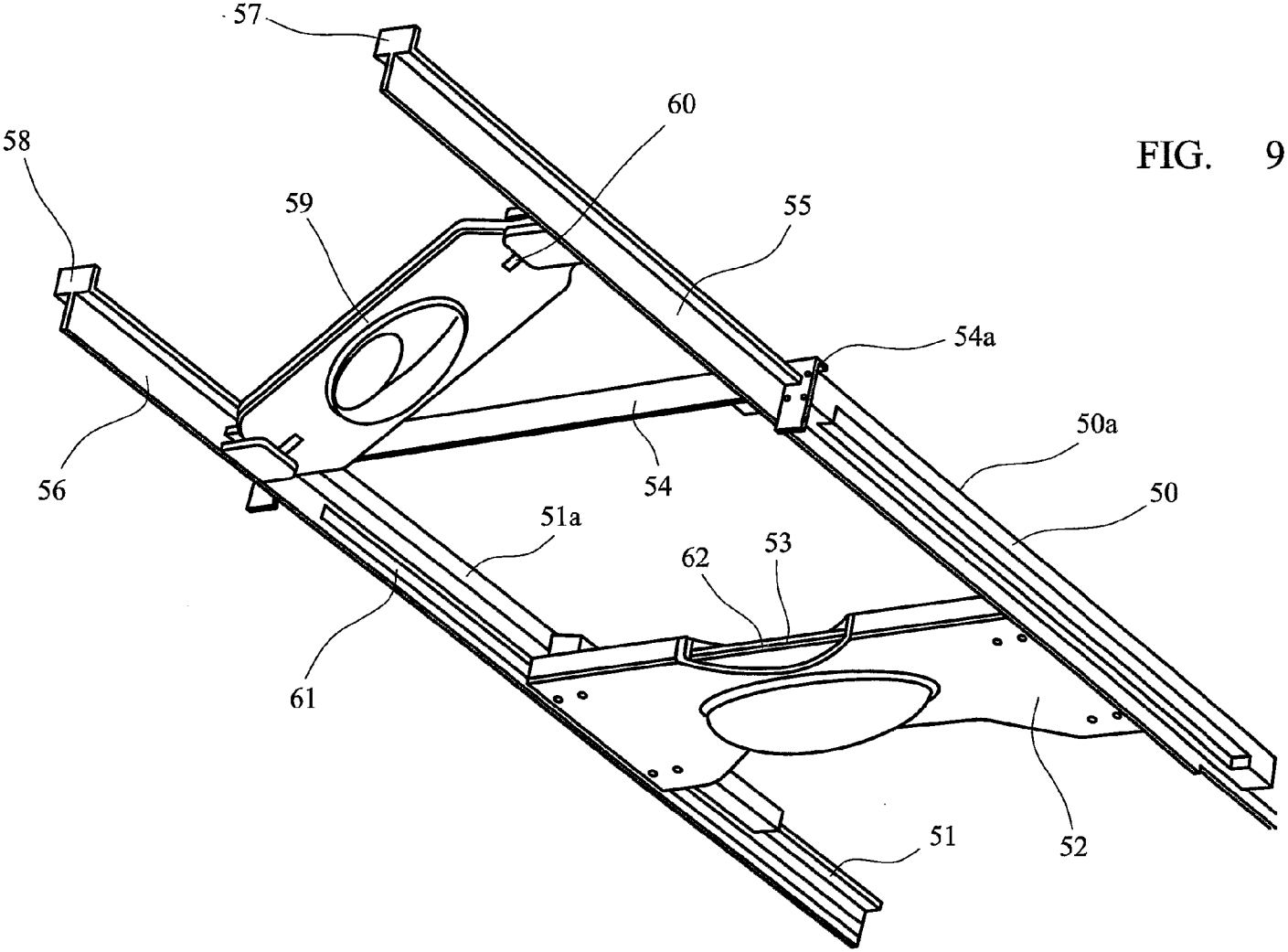
FIG. 9 shows a preferred embodiment of a guide tool for determining the cutting line on a tile.

Referring now to FIG. 9, there is shown from an underside view, a guide tool for determining the cutting line for the size of a tile, and the related rebate for those tiles, typically against a side wall of the ceiling which do not accommodate a full tile. The tool has two parallel spaced elongate side members 50 and 51, which are adjoined by a first crossmember 52 carrying a locking mechanism 53 and a second crossmember 54 spaced from the first cross member 52. The crossmember 54 projects upwardly beyond the upper faces 50*a* and 51*a* of the side members 50 and 51, respectively, and has at its upper free edge, a horizontally extending lip 54*a*, which is adapted to engage over the ceiling frame member spaced from the wall where the non-standard size tile is to fit. Each of the side members 50 and 51 has slidably located therein and projecting from one end an elongate spacing member 55 and 56, respectively. At their free ends, the spacing members 55 and 56 carry abutments 57 and 58, respectively, which, in operation, are adapted to abut the part of the ceiling frame secured to a wall. Although not shown, the ends carry markers such as a pin, which serve to mark the tile at the cutting stage to provide a cutting line. A further cross piece 59, which incorporates a lost motion device 60, serves as a guide to help keep the two members 55 and 56 in the correct location relative to each other, but its principal purpose is to serve as a hand hold to enable both members 55 and 56 to be moved simultaneously with one hand, even though they might need to be moved by different amounts. In operation, the tool is held with one hand on the transverse member 52 and the other hand holding the cross piece 59. The tool is then offered up to the ceiling framework and the crossmember 54 is arranged to abut the frame element spaced from the wall with the lip 54*a* engaging over the framework to accurately locate the tool.

The locking mechanism 53 includes on each of the spacing members 55 and 56 an elongate toothed rack 61, only one of which is shown, which is engaged by a tongue located in the transverse member 52 and biased into engagement by resilient means (not shown). The tongues are lifted out of engagement with the racks 61 by depressing a lever mechanism 62 in the transverse member 52. This can thus be done with the one hand which is holding the device in position, leaving the other hand of the operator free to move the spacing members 55 and 56 out to abut the opposing frame element as described previously. The lever mechanism 62 is then released so that the spacing members 55 and 56 are locked in position relative to the transverse member 54. The device is then placed on the tile to be cut with the transverse member 54 abutting one side edge of the tile. The marker points on the ends 57 and 58 of the space members 55 and 56 thus mark the tile at the correct location for the tile to be cut and a rebate formed by the cutting tool described earlier.

It will be understood that the embodiments are described by way of example only and that alternative forms of the apparatus are possible. For example, in a further form of the invention, the cutting tool may have three cutting wheels rotatable about spaced parallel axes, two of the cutting wheels performing the function of cutting the tile to size, as in the cutting wheels 42 and 43, the third cutting wheel being adapted to form the rebate cut in the face of the tile simultaneously with the tile being cut to size. The tool is then pivoted to a position in which the edge cut to form the rebate is made on the next stroke of the tool. This pivotal movement could be about an axis parallel to the axis of movement of the tool along the guide means.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A tile rebate cutting apparatus comprising:

a guide member forming a linear guide; and a rebate cutting tool including a chassis, said chassis slidably coupled to said guide member, said rebate cutting tool incorporating at least two rebate cutting devices, said rebate cutting tool adapted to engage with said guide member to move along a predetermined line determined by a position of said guide member to enable a plurality of rebate cuts forming a rebate to be made in a tile, a first of said rebate cutting devices arranged to make a first of said plurality of rebate cuts in a surface of said tile, a second of said rebate cutting devices arranged to make a second of said plurality of rebate cuts in an edge of said tile, said second of said plurality of rebate cuts located approximately perpendicular to said first of said plurality of rebate cuts and passing through said first of said plurality of rebate cuts to sever a piece of material from said tile to form said rebate; and a cutting tool carrier including a tile cutting part and a rebate cutting part, said rebate cutting part angularly positioned with respect to said tile cutting part in a manner in which said tile cutting part is pivoted to a position clear of said tile when said tile is cut by said rebate cutting part and said rebate cutting part is pivoted to a position clear of said tile when said tile is cut by said tile cutting part, a body of said cutting tool carrier pivotally mounted on said chassis to accommodate movement between a tile cutting position and a rebate cutting position.

2. An apparatus according to claim 1, wherein said guide member is formed by a spirit level.

3. An apparatus according to claim 1 further comprising:

a parting off tool, said parting off tool adapted to engage with said guide member to move along a predetermined line determined by a position of said guide member, and said parting off tool incorporating a parting off cutting device positioned relative to said guide member to cut said tile to size.

4. An apparatus according to claim 3 wherein said guide member includes at least one elongate member, said at least one elongate member including at least one raised guide rail extending throughout at least a portion of a length of said at least one elongate member; and wherein at least one of said rebate cutting tool, said parting off tool, and combinations thereof are adapted to engage with said at least one raised guide rail.

5. An apparatus according to claim 4, wherein said at least one raised guide rail is two parallel raised guide rails extending throughout at least a portion of a length of said at least one elongate member; and wherein said rebate cutting tool, said parting off tool, and combinations thereof are adapted to engage with said two parallel raised guide rails.

6. An apparatus according to claim 5, wherein at least one of the group consisting of said rebate cutting tool, said parting off tool, and combinations thereof includes an elongate groove or recess adapted to engage with at least one of the group consisting of said at least one raised guide rail and said two parallel raised guide rails.

7. An apparatus according to claim 3, wherein at least one of the group consisting of said guide member, a main body of said rebate cutting tool, a main body of said parting off tool, and combinations thereof is formed of an aluminum extrusion.

8. An apparatus according to claim 3, wherein at least one of the group consisting of said rebate cutting tool, said parting off tool, and combinations thereof includes a blade having an adjustable cutting depth.

9. An apparatus according to claim 8, wherein said blade is replaceable.

10. An apparatus according to claim 3, wherein at least one of the group consisting of said at least two rebate cutting devices, said parting off cutting device, and combinations thereof includes a rotatable cutting wheel.

11. An apparatus according to claim 10, wherein said rotatable cutting wheel is diamond tipped.

12. An apparatus according to claim 3, wherein said guide member is formed by a spirit level.

13. An apparatus according to claim 1, wherein a position of said tile cutting part relative to said rebate cutting part is adjustable.

14. An apparatus according to claims 1 or 13 further comprising:

a drive motor coupled to at least one of the group consisting of said tile cutting part, said rebate cutting part, and combinations thereof for driving at least one of the group consisting of said tile cutting part, said rebate cutting part, and combinations thereof.

15. An apparatus according to claim 14, wherein said drive motor is a battery powered electrical motor.

16. An apparatus according to claim 1 or 13, wherein at least one of the group consisting of said at least two rebate cutting devices, said tile cutting part, said rebate cutting part, and combinations thereof includes a rotatable cutting wheel.

17. An apparatus according to claim 16, wherein said rotatable cutting wheel is diamond tipped.

18. An apparatus according to claim 1, wherein said guide member is an extrusion of a constant cross section, and said chassis is slidably coupled to said guide member in a manner that limits or prevents lateral movement of said chassis.

19. An apparatus according to claim 1, wherein at least one of the group consisting of said guide member, a main body of said rebate cutting tool, and combinations thereof is formed of an aluminum extrusion.

20. An apparatus according to claim 1, wherein said rebate cutting tool includes a blade having an adjustable cutting depth.

21. An apparatus according to claim 20, wherein said blade is replaceable.

* * * * *